US008249262B2

(12) United States Patent
Chua et al.

(10) Patent No.: US 8,249,262 B2
(45) Date of Patent: Aug. 21, 2012

(54) DEVICE FOR ACOUSTICALLY ANALYZING A HEARING DEVICE AND ANALYSIS METHOD

(75) Inventors: Li Nah Chua, Singapore (SG); Tze Peng Chua, Singapore (SG); Harald Klemenz, Fürth (DE); Eng Cheong Lim, Singapore (SG); Pei Chyi Kristy Lim, Singapore (SG); Nisha Shakila Ma, Singapore (SG); Boon Lan Ng, Singapore (SG); Yong Kiat Ng, Singapore (SG); Diana Schmidt, Roth (DE); Yen Ling Elaine Tham, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 183 days.

(21) Appl. No.: 12/768,231

(22) Filed: Apr. 27, 2010

(65) Prior Publication Data

US 2010/0272273 A1 Oct. 28, 2010

(30) Foreign Application Priority Data

Apr. 27, 2009 (DE) ..... 10 2009 018 994

(51) Int. Cl.
*H04R 29/00* (2006.01)

(52) U.S. Cl. ..... 381/60; 381/58; 381/312; 381/322

(58) Field of Classification Search ..... 381/23.1, 381/58, 60, 312–331; 73/585; 600/559
See application file for complete search history.

(56) References Cited

U.S. PATENT DOCUMENTS

| | | | | |
|---|---|---|---|---|
| 7,496,205 | B2 * | 2/2009 | Kuhnel | 381/60 |
| 7,769,185 | B2 * | 8/2010 | Burns | 381/60 |
| 7,860,263 | B2 * | 12/2010 | Fischer | 381/318 |
| 8,059,847 | B2 * | 11/2011 | Nordahn | 381/328 |
| 2005/0123145 | A1 | 6/2005 | Kuhnel | |
| 2005/0259829 | A1 | 11/2005 | Van den Heuvel et al. | |
| 2007/0286429 | A1 | 12/2007 | Grafenberg et al. | |

FOREIGN PATENT DOCUMENTS

| | | | |
|---|---|---|---|
| DE | 20313063 | U1 | 3/2004 |
| DE | 10354897 | A1 | 6/2005 |
| DE | 102006026721 | A1 | 12/2007 |
| EP | 1416764 | A2 | 5/2004 |
| EP | 1865746 | A2 | 12/2007 |

* cited by examiner

*Primary Examiner* — Vivian Chin
*Assistant Examiner* — Fatimat O Olaniran
(74) *Attorney, Agent, or Firm* — Laurence A. Greenberg; Werner H. Stemer; Ralph E. Locher

(57) ABSTRACT

A device for acoustic analysis has a first hearing device with a first sound input and a first sound output and a second hearing device with a second sound input and a second sound output. The first hearing device is in acoustic communication with the second hearing device. The first hearing device can analyze the acoustic communication and output a corresponding result. Consequently, two hearing aids, for example, can test each other, and permit a user to check hearing devices and, in particular, hearing aids in a simple fashion without the hearing aid wearer having to visit an audiologist for the test.

12 Claims, 2 Drawing Sheets

DEVICE FOR ACOUSTICALLY ANALYZING A HEARING DEVICE AND ANALYSIS METHOD

CROSS-REFERENCE TO RELATED APPLICATION

This application claims the priority, under 35 U.S.C. §119, of German Patent Application DE 10 2009 018 994.7, filed Apr. 27, 2009; the prior application is herewith incorporated by reference in its entirety.

BACKGROUND OF THE INVENTION

Field of the Invention

The present invention relates to a device for acoustically analyzing a hearing device. Moreover, the present invention relates to a corresponding method for analyzing a hearing device.

The term "hearing device" as used herein is understood to mean any portable sound-emitting equipment in/on the ear or on the head, in particular a hearing aid, a headset, earphones or the like.

Hearing aids are portable hearing devices used to support the hard of hearing. In order to make concessions for numerous individual requirements, different types of hearing aids are provided, e.g. behind-the-ear (BTE) hearing aids, hearing aids with an external headset (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In that case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually constructed as an electroacoustic transducer, e.g. a miniaturized loudspeaker, or as an electromechanical transducer, e.g. a bone conduction headset. The amplifier is usually integrated into a signal-processing unit. That basic structure is illustrated in FIG. 1 using the example of a behind-the-ear hearing aid. One or more microphones 2 for recording sound from the surroundings are installed in a hearing aid housing 1 to be worn behind the ear. A signal-processing unit 3, likewise integrated into the hearing aid housing 1, processes the microphone signals and amplifies them. The output signal of the signal-processing unit 3 is transferred to a loudspeaker or headset 4, which emits an acoustic signal. If necessary, the sound is transferred to the eardrum of the equipment wearer using a sound tube, which is fixed in the auditory canal with an ear mold. A battery 5, likewise integrated into the hearing aid housing 1, supplies the hearing aid and in particular the signal-processing unit 3, with energy.

Hearing aids should be examined for possible defects, either routinely from time to time or in the case of a fault. Examinations can be carried out either by the user or by an audiologist. However, suitable equipment therefor is often unavailable, particularly in the case of hearing aids used in pediatric care. Quick self-checks are also either impossible or inaccurate.

Measurement possibilities for particular analyses, for example relating to the functionality of microphones or headsets, are currently unavailable to users. Thus, if a fault is suspected, the user has to visit an audiologist to have the hearing aid examined.

SUMMARY OF THE INVENTION

It is accordingly an object of the invention to provide a device for acoustically analyzing a hearing device and an analysis method, which overcome the hereinafore-mentioned disadvantages of the heretofore-known devices and methods of this general type and which provide a user of a hearing device with an analysis possibility for detecting faults.

With the foregoing and other objects in view there is provided, in accordance with the invention, a device for acoustically analyzing a hearing device, comprising a first hearing device, which has a first sound input and a first sound output, and a second hearing device, which has a second sound input and a second sound output, wherein the first hearing device is in acoustic communication with the second hearing device and the first hearing device can analyze the acoustic communication and output a corresponding result.

With the objects of the invention in view, there is also provided a method for acoustically analyzing a hearing device by acoustic interaction between a first hearing device and a second hearing device, analysis of the interaction through the use of the first hearing device or through the use of a separate analysis apparatus, and output of an analysis result by the first hearing device.

The device according to the invention and the method according to the invention advantageously allow one hearing device to be checked acoustically by another hearing device. In particular, this allows, for example, a self-check of the two hearing aids for binaural care. Specifically, hearing aid wearers themselves are thus able to check whether or not the microphones and headsets of their hearing aids are fully functional.

In accordance with a first embodiment of the invention, the two hearing devices can communicate in an acoustic fashion with one another over a tube system, wherein each of the first sound input, the second sound input, the first sound output and the second sound output are respectively disposed at one end of a separate tube of the tube system. In this case, a "separate tube" should be understood to mean part of the tube system. That is to say separate tubes can also be interconnected. This tube system transports the test sounds required for the analysis from the sound outputs to the sound inputs of the hearing devices in a targeted fashion. An outside influence can largely be prevented thereby.

In accordance with another feature of the invention, the other ends of the separate tubes are interconnected, as indicated above. In particular, the separate tubes can run together at a point in a star-shaped fashion. Using this also allows the generation and measurement of interferences of the sound signals of both sound outputs.

In accordance with a further feature of the invention, a multiple path switch can be disposed at the other ends of the separate tubes. The switch can selectively interconnect two, three or four tubes. If need be, this can be used to carry out more specific tests.

In accordance with an alternative embodiment of the invention, the analysis device has a closed container, into which the first and the second hearing device have been inserted in such a way that the two hearing devices communicate with one another acoustically by direct mutual acoustic irradiation and/or through reflections off the walls of the container. This also allows test sounds to be sent back and forth between the hearing devices or interferences to be observed, largely without influence from the external surroundings.

In accordance with a further embodiment of the invention, the two hearing devices can have an electromagnetic data interconnection for analysis purposes. By way of example, both hearing devices can thereby automatically initiate and synchronize the analysis.

In accordance with an added feature of the invention, the first hearing device may be able to analyze an acoustic signal with respect to levels, oscillations, beats and/or interferences. This makes it possible to obtain relatively reliable information relating to the functionality of microphones and headsets of the hearing devices.

In accordance with an additional feature of the invention, the first hearing device can have a signal generator for generating a test sound. The generator can advantageously be integrated into a hybrid-circuit of a hearing device or of a hearing aid.

In accordance with yet another feature of the invention, the second hearing device (to be analyzed) may be able to output a recorded test sound in an amplified fashion at an unchanged frequency. Output signals with changes in the frequency then indicate corresponding processing errors.

In accordance with yet a further preferred embodiment of the invention, the result of the analysis can be transmitted from the first hearing device to a remote control and can be rendered by the remote control. By way of example, this allows hearing aid wearers to determine, in a comfortable fashion, whether or not one of their hearing aids is defective.

In accordance with yet an added feature of the invention, in a particular refinement, the first hearing device can be identical to the second hearing device. Then this one hearing device supplies a test sound from its sound output to its sound input, for example over a tube or through the use of reflection inside a container. This allows the hearing device or hearing aid to perform an acoustic self-check.

In accordance with a further embodiment of the invention, a chip can be plugged on the first hearing device and it can prompt the first hearing device to analyze the second hearing device according to test data stored on the chip. The chip can also initiate the analysis per se. This, for example, allows complex analyses to be carried out by hearing aids, without correspondingly extensive data having to be stored on the hearing-aid-internal chips or signal-processing units.

In accordance with an alternative embodiment of the invention, the device has an analysis apparatus that is separate from the first and the second hearing device and can analyze the acoustic connection in place of the first hearing device. This analysis device can be integrated in a case or a remote control. In the process, it can also be advantageous for the analysis apparatus to analyze interference between the output sounds of both hearing devices. This allows the detection of minimal differences between the two hearing devices in a simple fashion.

Other features which are considered as characteristic for the invention are set forth in the appended claims.

Although the invention is illustrated and described herein as embodied in a device for acoustically analyzing a hearing device and an analysis method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Referring now to the figures of the drawings in detail, there are seen exemplary embodiments which are explained in more detail below and constitute preferred embodiments of the present invention.

The following examples show the analysis of hearing devices on the basis of hearing aids, in particular of two hearing aids for binaural care (left hearing aid and right hearing aid). The analysis is carried out either by one hearing aid, by both hearing aids or by a simple, separate analysis apparatus. In the process, the most diverse methods can be used to examine the output sound of a hearing aid, the input signal of a hearing aid or the interaction of the output sounds of two hearing aids (interferences). In particular, the signals can be examined with respect to levels, oscillations, beats, interferences, sound pressures, settling times, decay times and the like.

Figure 1:
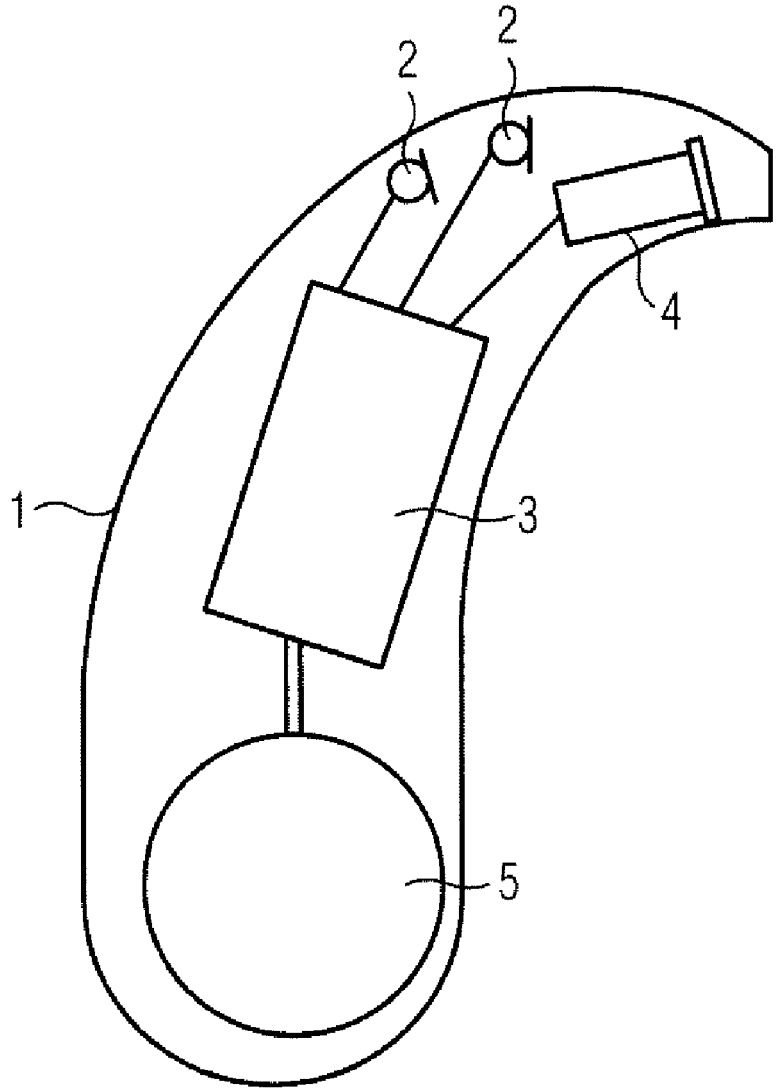
FIG. 1 (Prior Art)
FIG. 1 is a diagrammatic, cross-sectional view of a basic structure of a hearing aid according to the prior art.
Figure 2:
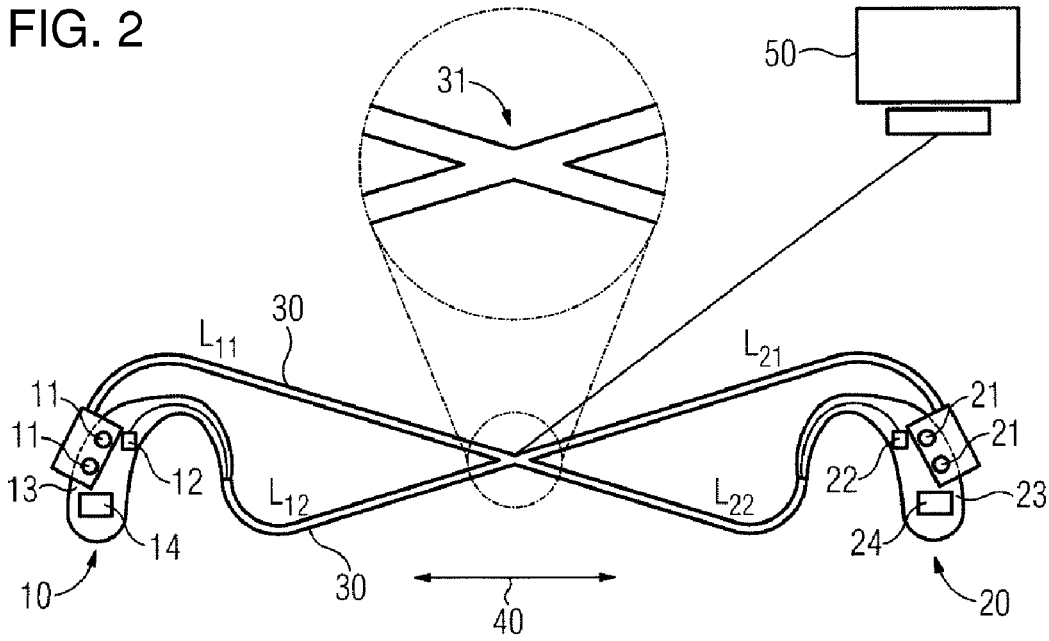
FIG. 2 is an elevational view of an analysis system with two hearing aids according to a first embodiment of the invention.

In the following example, the interferences between the output sounds of two hearing aids are examined. A measurement structure according to FIG. 2 is suitable therefor. A first hearing aid 10 is used for analyzing or measuring a second hearing aid 20. In this case, the first hearing aid 10 has two microphones 11 and one headset 12. The second hearing aid 20 likewise has two microphones 21 and one headset 22. The sound inputs and the sound outputs of the two hearing aids 10, 20 are interconnected by a tube system 30. In this case, the tube system 30 has four individual tubes $L_{11}$, $L_{12}$, $L_{21}$ and $L_{22}$. In this case, all of the tubes are interconnected at a common crossing point 31. This crossing point 31 is illustrated in an enlarged, fragmentary portion of FIG. 2. The respective free ends of the tubes are connected to a sound input or a sound output on one of the two hearing aids. Thus, the free end of the tube $L_{11}$ is connected to the microphones 11 of the first hearing aid 10, preferably in an acoustically sealed fashion. The tube $L_{12}$ is plugged on the sound output on the tone hook of the hearing aid 10. Similarly, the tube $L_{21}$ is connected to the microphones 21 of the second hearing aid 20 and the tube $L_{22}$ is connected to the sound output on the tone hook of the second hearing aid 20.

Moreover, each of the two hearing aids 10, 20 has a respective computer interface 13, 23 through the use of which test signals or test programs can be input into the respective hearing aid. Moreover, in this case, each of the two hearing aids 10, 20 has a respective chip 14 and 24 for storing or generating test signals. If need be, such a chip in the style of a dongle can also be plugged on one or both hearing aids 10, 20 in order to carry out or initiate the test.

A double-headed arrow 40 indicates that the two hearing aids 10, 20 have a wireless communication connection. Furthermore, provision can be made for an additional analysis apparatus 50 if the hearing aids 10, 20 do not carry out the tests, or do not carry them out alone. In the present case, the analysis apparatus 50 picks up the signals at the crossing point 31 by using a sensor. In the process, not only sound levels or sound pressures can be measured at the crossing point 31 of the tube system, but interferences and the like can also be determined.

In the following concrete example, interferences are measured. One of the two hearing aids, for example the first hearing aid 10, is used as a reference and it should check the status of the components of the second hearing aid 20. The chip 14 is used as a signal source for a test sound. In order to ensure that the second hearing aid 20 also emits a corresponding test sound, a corresponding signal is transmitted from the first hearing aid 10 to the second hearing aid 20 through the wireless connection 40. The chip 14 can also execute an entire test program and correspondingly control the first hearing aid 10 and the second hearing aid 20 through the wireless connection 40. Thus, in this case, the first hearing aid 10 acts as the master hearing aid for the analysis. By way of example, the analysis results are shown to the user through the use of the analysis apparatus 50 or another rendering apparatus. For example, a cover of the hearing aids with an appropriate display unit or a remote control of the hearing aids can be used for this purpose. Depending on whether one of the hearing aids 10, 20 or the further analysis unit 50 has collected analysis results, the respective unit transmits these analysis results, if necessary, to one of the mentioned rendering devices for further processing or for output purposes.

In particular, the second hearing aid 20 can be tested by a sound signal of a predetermined programmed frequency originating from the first hearing aid 10. This sound signal is output by the headset 12 of the first hearing aid 10 and is guided to the microphones 21 of the second hearing aid 20 through the tubes $L_{12}$ and $L_{21}$. The second hearing aid 20 records the test sound with the particular frequency using its microphones and sends back a sound signal at the same frequency. This is carried out by its headset 22 leading to the microphones 11 of the first hearing aid 10 through the tubes $L_{22}$ and $L_{11}$. This loop can ensure the correct functioning of the second hearing aid 20. If there is a difference in the output sounds of the two hearing aids 10, 20, this is a sign that, with high probability, the second hearing aid 20 is defective.

Figure 3:
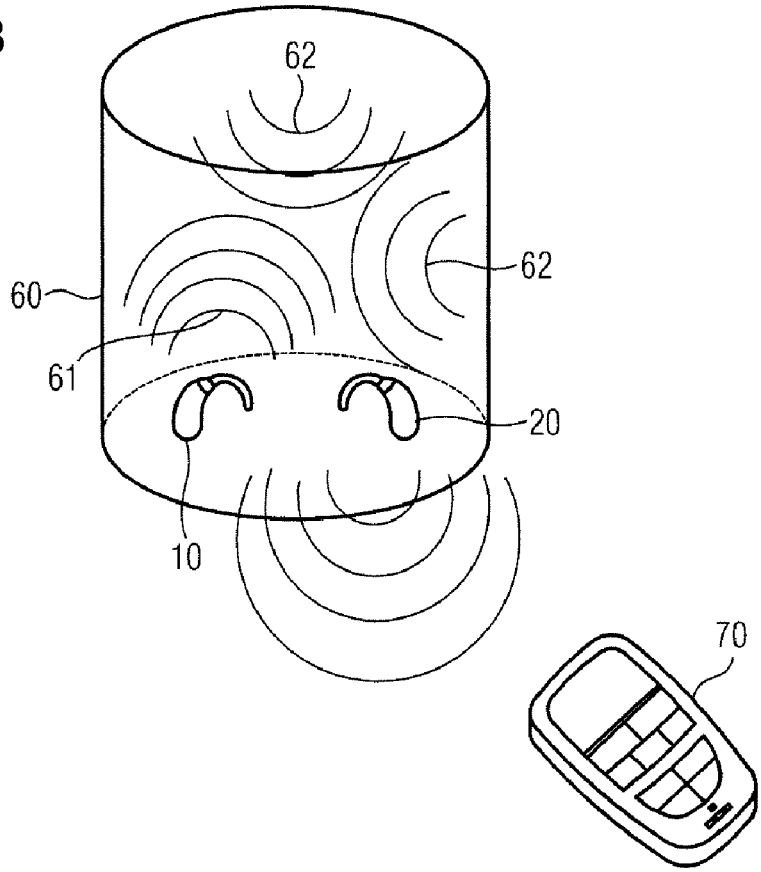
FIG. 3 is a perspective view of an analysis system with two hearing aids according to a second embodiment of the invention.

According to a further exemplary embodiment, it is also possible for different sound variables to be analyzed for the analysis. For this purpose, the hearing aids can be interconnected by the tube system 30, like in the example of FIG. 2. However, alternatively, the two hearing aids can also be examined in a closed container, for example the container of a charging station. Such a container 60 has been reproduced diagrammatically in FIG. 3. The two hearing aids 10 and 20 are located in the container 60. Sound signals 61 emitted by the hearing aid 10 are reflected off the walls of the container 60. This creates reflected signals 62. These emitted signals 61 and reflected signals 62 are used for the analysis. In principle, a single hearing aid can thus perform a self-check in the container 60.

A specific analysis can then be performed as follows: the first hearing aid 10 firstly emits a test signal from its sound output, and this test signal is recorded by the second hearing aid 20 using its microphones 21. The second hearing aid 20 can check its two microphones 21 independently of one another. If neither microphone of the second hearing aid 20 produces a signal, the first hearing aid 10 can test the signal by using its own microphones 11. Should no signal be recorded in this case either, it is very likely that the headset of the first hearing aid 10 is defective. The result can be transmitted wirelessly, for example, to a remote control 70 in order, for example, to illustrate this graphically at that location.

In the other case, where a signal is measured, but this signal deviates from a conventional signal, a statement can likewise be made through the use of the measuring device into which the hearing aids are integrated. Then, for example, the container 60 is not completely closed or a microphone or the headset is blocked. If only high signal components reach the microphones, while the low signal components by contrast are lost, it is very likely that the test container 60 or the tubes of the tube system 30 has or have a small hole or is or are not completely closed. In the other case, in which low-frequency signal components reach the microphones and higher frequencies are lost, it is very likely that the headset or the microphones are defective or blocked.

According to a further exemplary embodiment, the following measurement procedure can be undertaken in order to determine a defective microphone (Mic) or a defective headset, with sound levels being measured:

1. The output signal of the first hearing aid 10 is measured by Mic1 of the second hearing aid 20. Should the measurement be erroneous, the headset of the first hearing aid 10 or the Mic1 of the second hearing aid 20 can be defective.
2. The output signal of the first hearing aid 10 is measured by Mic2 of the second hearing aid 20. Should the measurement be erroneous, the probability of the headset of the first hearing aid 10 being defective has increased.
3. The output signal of the first hearing aid 10 is measured by Mic1 of the first hearing aid 10. Should the measurement be erroneous, the headset is defective with a probability of, for example, 25% (depending on the preceding measurements and the distribution of the defect-probabilities of the individual components).
4. The output signal of the first hearing aid 10 is measured by Mic2 of the first hearing aid 10. Should the measurement be erroneous, the headset is defective with a probability of, for example, 20%.
5. The output signal of the second hearing aid 20 is measured by Mic1 of the second hearing aid 20. Should the measurement be erroneous, the headset of the second hearing aid 20 or the Mic1 of the second hearing aid 20 can be defective.
6. Et cetera.

If all of the measurements are compared to expected values using cross calculations and probability measurements, a defective component or a malfunction can be determined with a high probability after one test series.

The individual tests can also be varied by giving the hearing aids a different acoustic coupling for the analysis than what is illustrated in FIG. 2. By way of example, a multiple path switch could be installed at the intersection 31, which switch interconnects the tubes $L_{11}$, $L_{12}$, $L_{21}$ and $L_{22}$ in an arbitrary fashion. Thus, the tubes can, for example, be selectively interconnected in groups of two, three or four tubes.

The invention claimed is:

1. A device for acoustically analyzing a hearing device, the device comprising:

a first hearing device having a first sound input and a first sound output; and a second hearing device having a second sound input and a second sound output;

a tube system over which said first and second hearing devices are in acoustic communication with one another, said tube system having separate tubes with ends;

each of said first sound input, said second sound input, said first sound output and said second sound output being disposed at a respective one of said ends of a respective one of said separate tubes; and said first hearing device being configured to analyze said acoustic communication and output a corresponding result.

2. The device according to claim 1, wherein said ends of said separate tubes at which said inputs and outputs are not disposed are interconnected.

3. The device according to claim 1, which further comprises a multiple path switch disposed at said ends of said separate tubes at which said inputs and outputs are not disposed, for selectively interconnecting two, three or four of said separate tubes.

4. The device according to claim 1, which further comprises a chip plugged on said first hearing device for prompting said first hearing device to analyze said second hearing device according to test data stored on said chip.

5. The device according to claim 1, wherein said first hearing device is configured to analyze an acoustic signal with respect to at least one of levels, oscillations, beats or interferences.

6. The device according to claim 1, which further comprises an analysis apparatus being separate from said first and second hearing devices for analyzing said acoustic communication in place of said first hearing device.

7. The device according to claim 6, wherein said analysis apparatus is configured to analyze interference between output sounds of both of said hearing devices.

8. The device according to claim 1, which further comprises a remote control, said result of said analysis to be transmitted from said first hearing device to said remote control and reproduced by said remote control.

9. The device according to claim 1, wherein said first hearing device is identical to said second hearing device.

10. A method for acoustically analyzing a hearing device, the method comprising the following steps:

providing a first hearing device having a first sound input and a first sound output and a second hearing device having a second sound input and a second sound output;

carrying out acoustic interaction between the first hearing device and the second hearing device over a tube system having separate tubes with ends, each of the first sound input, the second sound input, the first sound output and the second sound output being disposed at a respective one of the ends of a respective one of the separate tubes;

analyzing the interaction with the first hearing device or with a separate analysis apparatus; and outputting an analysis result with the first hearing device.

11. The method according to claim 10, which further comprises plugging a chip onto the first hearing device for analysis purposes, and at least one of initiating the analysis or providing test data for the analysis with the chip.

12. The method according to claim 10, which further comprises analyzing interference between interacting output sounds of the two hearing devices.

* * * * *